United States Patent [19]

Maddux et al.

[11] Patent Number: 4,557,268

[45] Date of Patent: Dec. 10, 1985

[54] UNDER GARMENT PROVIDING SUPPORT

[76] Inventors: Irene H. Maddux; Gordon T. Maddux, both of 2118 Linnington Ave., W. Los Angeles, Calif. 90025

[21] Appl. No.: 631,955

[22] Filed: Jul. 18, 1984

[51] Int. Cl.[4] ..... A41C 1/08

[52] U.S. Cl. ..... 128/579 R

[58] Field of Search ..... 128/579 R, 546, 518, 128/544

[56] References Cited

U.S. PATENT DOCUMENTS 2,981,258 4/1961 Moellendorf ..... 128/579 R 3,273,563 9/1966 Bonange ..... 128/279 R

*Primary Examiner*—Doris L. Troutman

*Attorney, Agent, or Firm*—Nilsson, Robbins, Dalgarn, Berliner, Carson & Wurst

[57] ABSTRACT

An under garment for wear to provide both lower back and abdominal support and particularly adapted for wear by a pregnant woman. The garment is a panty having a body with a first continuous belt secured thereto to encircle the wearer around the lower portion of the abdomen and above the buttocks of the wearer. The first belt includes a fastening means providing adjustment of tension and to accommodate growth. A second belt is secured to the rear of the body of the panty and includes distal portions adapted for attachment to the garment and more specifically to the first belt to provide lower back support.

13 Claims, 5 Drawing Figures

FIG. 1
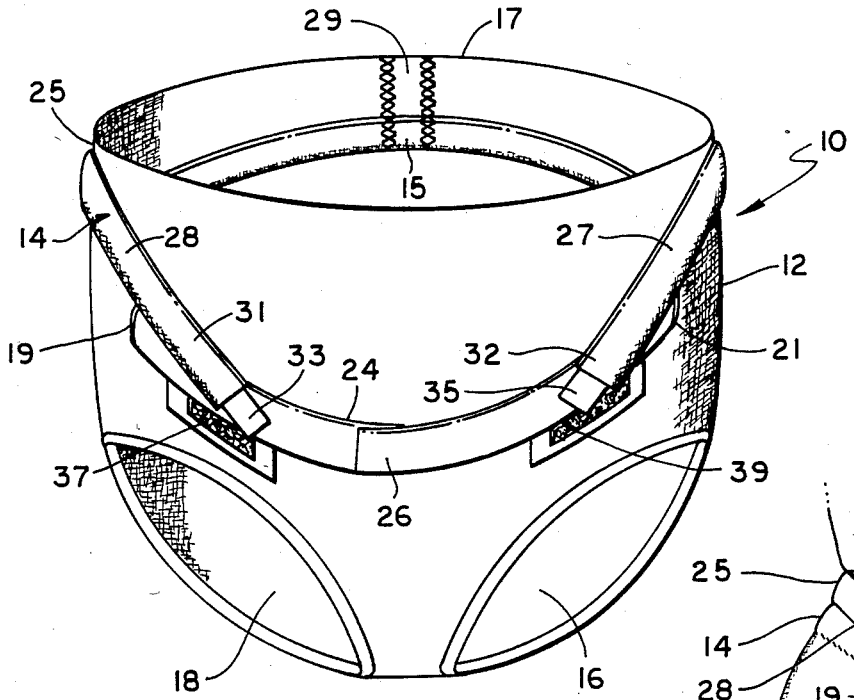
FIG. 2
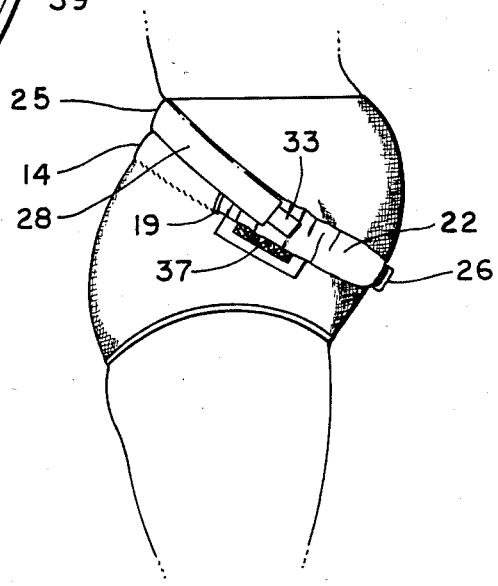
FIG. 3
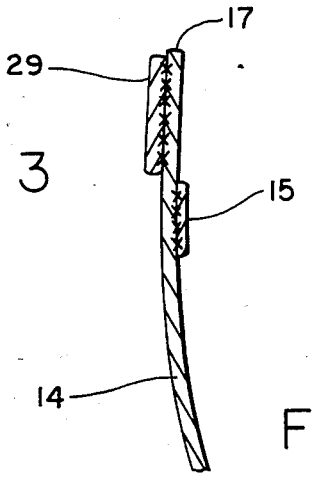
FIG. 5
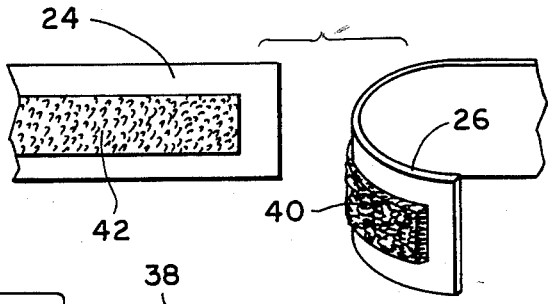
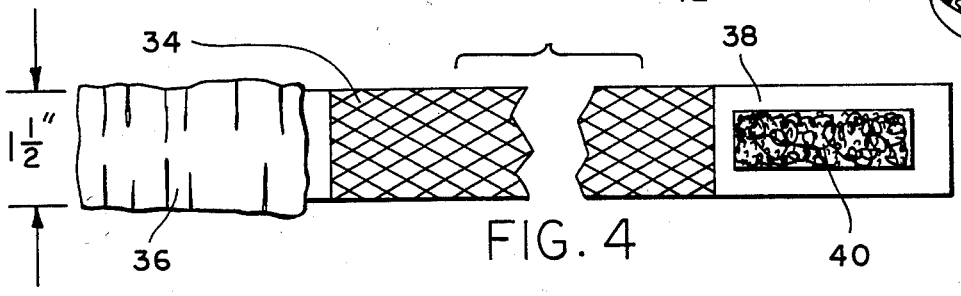
FIG. 4

UNDER GARMENT PROVIDING SUPPORT

BACKGROUND OF THE INVENTION

1. Field of the Invention

This invention relates generally to support-providing under-garment wearing apparel and more specifically to such apparel in the form of a panty more specifically adapted for use by pregnant women.

2. Prior art

It has been common practice for women to wear girdles or other support-type structures separately and together with panties during pregancy and otherwise. Such prior art structures, however, are often uncomfortable and are difficult and burdensome to use. Those prior art devices which do provide comfort for the wearer do not provide adjustability of the garment to accommodate physical changes as pregnancy progresses. The best prior art known to Applicant is shown in U.S. Pat. Nos. 2,711,542; 2,763,009; 2,863,152; 2,981,258; 3,931,816; and 4,325,379.

SUMMARY OF THE INVENTION

An undergarment including a panty having a body of resilient material and having a first body encircling band of adjustable material having a width of at least 1½ inches and is disposed to fit at the front portion of the body of the panty beneath the belly of the wearer and further including fastening means for adjustably securing the band about the wearer's body and a second belt-like member for providing lower back support to the wearer. Each of the bands further includes fastening means for adjustably securing the bands about the wearer's body.

BRIEF DESCRIPTION OF THE DRAWINGS

FIG. 1 is a perspective view from the front of a garment constructed in accordance with the present invention;

FIG. 2 is a side view of the garment in place upon a wearer;

FIG. 3 is a fragmentary view, in cross section, showing the manner in which the belt is retained upon the body of the panty garment;

FIG. 4 is a fragmentary view showing the construction of the belt; and

FIG. 5 is a partial fragmentary view illustrating in further detail one form of fastening means for use with the belt.

DESCRIPTION OF THE PREFERRED EMBODIMENT

As is shown in the drawing, there is provided a garment 10 which includes a panty 12 having a body portion 14 with appropriate leg openings 16 and 18 therein. The body 14 is formed of resilient material to assist in supporting the wearer. The material may have a substantial stretch in the vertical direction as viewed in FIG. 1 but less in the horizontal direction. The preferred material from which the body 14 is formed is identified as Spandex Lycra knit and functions to snugly fit upon the body of the wearer. It will, however, be recognized by those skilled in the art that other stretchable fabrics may function equally well.

A first or lower band or belt 22 is secured to the body 14 at the back portion 15 thereof below the top edge 17. The ends 24 and 26 of the belt 22 are provided with fastening means so that the belt may be adjusted about the body of the wearer. The body 14 of the garment 10 defines a pair of openings 19 and 21 through which the belt 22 extends. As will be appreciated particularly from FIG. 2, the belt 22 encircles the body of the user and extends from a position below the top edge 17 of the body 14 and thus above the buttocks and to the lower part of the abdomen of the wearer. In addition thereto the fastening means affixed to the ends 24 and 26 of the belt 22 is adjustable so that the tension which is applied by the belt to the body of the wearer may be adjusted, depending upon a number of facts such as comfort to the wearer, if the wearer is a pregnant woman, to the growth of the fetus and the like.

A second or upper band or belt-like member 25 having sections 27 and 28 is affixed to the back edge of the garment as shown at 29 and is positioned so that the top edge thereof is substantially at the same level as the top edge 17 of the body 14 of the garment 10. As is noted, the member 25 is affixed to the outer portion of the body 14 of the garment 10 and as is the case with the belt 22, is permanently stitched to the body 14. The ends 31 and 32 of the belt 28 are provided with fastening means adapted so that the belt 25 may be adjusted to provide the wearer with the desired lower back support. Fastening means 33 and 35 are affixed to the ends 31 and 32 of the member 25 are designed so as to secure or anchor the ends 31 and 32 to the outer nylon flannel encasement of belt 22 as will be more fully described below. As is clearly shown in FIGS. 1 and 2 the member 25 provides substantial support to the lower back of the wearer. This feature is particularly important to pregnant women. As the fetus grows the increased weight in front creates fatique and pain in the lower back. The belt 25 with its adjustability balances this condition.

As will be appreciated by those skilled in the art, each of the belts 22 and 25 is preferably constructed from resiliently deformable material such as elastic so that the tension and support provided by each of the belts independently and together may be adjusted as desired under the varying circumstances of use and wear. It will also be appreciated by those skilled in the art that by positioning the belts at the rear portion of the body 14 of the garment 10 to extend from substantially the waistline to a point displaced therefrom downwardly that substantial support to the lower back is provided to thereby alleviate low back fatigue and pain which is often associated with those individuals carrying a substantial amount of weight in the abdomen area. Particularly, the garment constructed in accordance with the present invention provides such support for pregnant women and all persons having substantial overweight conditions.

As above stated, the garment 10 is particularly adapted for use by pregnant women and has been found to be surprisingly useful to pregnant women involved in various athletic activities. The use of the garment constructed in accordance with the present invention provides substantial support for the fetus because the belt 22 is adapted to fit about the lower portion of the abdomen as is more clearly shown in FIG. 2. As is also shown, the belt totally encircles the body 14 of the user and is retained in place and position by the openings 19–21 in the body 14 of the garment. Through the utilization of the fastening means the ends 24 and 26 of the belt 22 can be secured in various positions to provide the desired amount of force to properly support the fetus. It will further be recognized that as the abdomen extends during the latter stages of pregnancy, the belt may be adjusted to accommodate the same. These features also tend to decrease the stretch marks on the abdomen of the mother.

The belt 22 as is more clearly shown in FIG. 4 is an elongated member 34 of elastic material which has a width dimension of at least 1½ inches to provide sufficient support for the fetus and at the same time to provide comfort for the wearer. It has been found that if the width is much less than the 1½ inches, then the belt will tend to bind or cut into the body of the wearer and provide substantial discomfort. The elastic member 34 is encased with a cloth material as shown at 36 and 38 (which has been broken away to illustrate the members 34) and to which the fastening means, one part of which is shown at 40, is attached. The encasing material 36–38 is effectively gathered along the belt 22 to provide stretching of the belt. However, by making the encasing material of non-stretch fabric, the amount of elasticity of the belt 22 may be regulated. In addition, the encasing material functions to provide an anchor for the fastening means 33 and 35 on the ends 31 and 32 of the member 25. That is, the fastening means 33 and 35 is constructed of hook-like projections which engage the encasing material, the combination functioning as a Velcro-type fastener. Alternatively, a separate strip of material (female Velcro, nylon flannel or the like) may be affixed to the side of the outer surface of the body 14 as shown at 37 and 39 to which the distal portions of the member 25 may be affixed with the anchoring means 33 and 35 (male Velcro or the like). In either event, the member 25 may be adjusted by the wearer to provide the desired lower back support by pulling down on the distal portions and engaging the fasteners 33 and 35 to the belt 22 or the members 37 and 39.

As is shown in FIG. 5 the ends 24 and 26 of the belt 22 have the fastening means 40 and 42 affixed to opposed, overlapping faces thereof. In a preferred embodiment as illustrated in the drawings, the fastening means 40 and 42 are made of a pair of self-fastening tapes including hook-like projections. Alternatively one may include a fuzz-like matt. Thus, upon pressing these two opposed faces together they become fastened. This type of fastening arrangement is known in the market under the name "VELCRO" and may be easily adjusted by the wearer as is well known.

What is claimed is:

1. An undergarment providing support for a user comprising a panty having a body portion;

a first belt affixed permanently to said body portion for completely surrounding the user from above the buttocks to below the abdomen;

means for retaining the belt in position about the body portion of the panty;

adjustable fastening means secured to opposite ends of the belt for adjustably fastening the belt about the body of the wearer; and a second belt affixed permanently to said body portion above said first belt for providing lower back support for said user.

2. The garment as defined in claim 1 wherein the means for retaining said first belt includes first and second openings defined by the body of the panty with said first belt extending therethrough.

3. The garment as defined in claim 1 wherein said first belt has a width of at least about 1½ inches.

4. The garment as defined in claim 1 wherein said second belt further includes fastening means secured to the distal ends thereof.

5. The garment as defined in claim 2 wherein said first belt is a continuous member of elastic material with the opposed overlapping ends thereof carrying the fastening means.

6. The garment as defined in c1aim 4 wherein said second belt is a member of elastic material with the distal ends thereof carrying the fastening means.

7. The garment as defined in claim 1 wherein said first and second belts are affixed at substantially the middle thereof to said body portion only at the rear thereof.

8. The garment as defined in claim 7 wherein said second belt is affixed to said body portion at substantially the upper part thereof and said first belt is affixed below said second belt.

9. The garment as defined in claim 8 wherein said first belt is affixed to the inside of said body portion and said second belt is affixed to the outside of said body portion.

10. The garment as defined in claim 9 wherein said first and second belts are encased in fabric.

11. The garment as defined in claim 9 wherein said garment further includes means to which the ends of said second belt may be separately anchored.

12. The garment as defined in claim 11 wherein said anchor means is the fabric in which said first belt is enclosed.

13. The garment as defined in claim 11 wherein said attachment means includes additional strips of material permanently affixed to the outer surface of said body adjacent said first belt.

* * * * *